United States Patent [19]

Haruta et al.

[11] Patent Number: 5,011,644

[45] Date of Patent: Apr. 30, 1991

[54] PROCESS FOR PRODUCING GEL FIBER

[75] Inventors: Masahiro Haruta, Tokyo; Hirohide Munakata; Satoshi Yuasa, both of Yokohama; Yoko Yoshinaga, Machida, all of Japan

[73] Assignee: Canon Kabushiki Kaisha, Tokyo, Japan

[21] Appl. No.: 342,665

[22] Filed: Apr. 24, 1989

Related U.S. Application Data

[63] Continuation of Ser. No. 938,283, Dec. 5, 1986, abandoned.

[30] Foreign Application Priority Data

Dec. 11, 1985 [JP] Japan ..... 60-277032

[51] Int. Cl.[5] ..... D01F 6/26

[52] U.S. Cl. ..... 264/184; 264/22; 264/205; 264/211.14; 264/211.15; 264/211.16; 264/342 R; 264/343

[58] Field of Search ..... 252/315.01, 315.1; 264/205, 176.1, 184, 22, 211.14, 211.15, 211.16, 342 R, 343

[56] References Cited

U.S. PATENT DOCUMENTS

| | | | |
|---|---|---|---|
| 3,055,729 | 9/1962 | Richter, Jr. et al. | 264/184 |
| 3,356,626 | 12/1967 | Reeder | 264/184 |
| 4,041,231 | 8/1977 | Gross et al. | 264/184 |
| 4,415,428 | 11/1983 | Nochumson et al. | 204/301 |
| 4,432,881 | 2/1984 | Evani | 252/315.1 |
| 4,560,522 | 12/1985 | Bastioli et al. | 264/561 |
| 4,657,656 | 4/1987 | Ogawa | 252/315.1 |

*Primary Examiner*—Hubert C. Lorin

*Attorney, Agent, or Firm*—Fitzpatrick, Cella, Harper & Scinto

[57] ABSTRACT

A process for producing a gel fiber comprises a step (N) of spinning a solution containing at least one polymer having at least one monomer unit as a constituent component for a gel to solidify the solution into a fiber, and step (M) of effecting crosslinking of the fiber to form a gel which can be swelled or shrunk reversibly by a thermal action in the presence of a liquid.

8 Claims, 1 Drawing Sheet

PROCESS FOR PRODUCING GEL FIBER

This application is a continuation of application Ser. No. 938,283 filed Dec. 5, 1986, now abandoned.

BACKGROUND OF THE INVENTION

1. Field of the Invention

This invention relates to a process for producing a fiber comprising a gel, particularly to a process for producing a fiber comprising a gel having the property of reversibly swelling and shrinking by an external action.

2. Related Background Art

A process for producing a synthetic fiber generally includes the spinning step of forming a polymer as the source material into a state readily flowable according to the method suitable for its physical properties, namely dissolving the polymer in an appropriate solvent to prepare a solution or melting the polymer into a molten state and extruding the solution or the melt through a nozzle with a predetermined size to solidify it into a fiber and the finishing step corresponding to various requirements for improvement of the physical properties of the fiber obtained.

As the spinning method when using a solution of a polymer as the dope for spinning, there are the wet spinning method and the dry spinning method.

The wet spinning method is a method for obtaining a polymer fiber by spinning out, namely extruding through a spinneret for spinning a solution of a polymer for formation of fiber (dope for spinning) into a solution for coagulation of said polymer, elongating the discharged liquid stream to a filament with a desired thickness and collecting the filament by means of a mechanical device such as rotatory bobbin, centrifugal device, etc. Fibers such as vinylon or acrylic fibers are produced according to this method.

For example, in production of vinylon using polyvinyl alcohol which is a water-soluble polymer as the source material, an aqueous PVA solution with a concentration of about 15% is used as the dope for spinning, while an aqueous solution of a salt such as Glauber's salt, ammonium sulfate, etc., or an alkali such as sodium hydroxide, etc., is used as the liquid for coagulation of the polymer.

On the other hand, the dry spinning method is a method in which the dope for spinning is extruded through a spinneret for spinning into a heated gas to solidify the polymer by evaporation of the solvent in the dope for spinning. Vinylon, acrylic fibers, vinyl chloride fibers, etc., have been produced according to this method.

For example, in production of vinylon according to the dry spinning method, an aqueous PVA solution with a high concentration of about 30 to 50% is used as the dope for spinning and the solution is spun into heated gas.

When the desired physical properties cannot be satisfactorily obtained in the fiber formed by the spinning step, the step for improving the physical properties of the fiber is further practiced if desired.

For example, in production of vinylon as mentioned above, the heat treatment step and the acetalization step are conducted after the spinning step.

In the heat treatment step practiced here, the fiber is heated in air of 210° to 220° C., whereby crystallization of the fiber progresses to impart primarily water resistance and strength to the fiber. On the other hand, in the acetalation step, the fiber subjected to the above heat treatment step is treated by dipping in an aqueous solution containing formaldhyde, sodium sulfate and sulfuric acid at prescribed concentrations, optionally under heating. By this treatment, hydrophilic hydroxyl groups in the polymer are crosslinked with each other to make the fiber resistant to hot water.

The synthetic fibers produced according to the methods as described above have been utilized primarily as fibers for clothing, or as fibers for industrial use such as ropes, tires, various fillers, etc., and these fibers are generally demanded to have sufficient tensile strength and water resistance, or adequate stretchability and uniformness in shape. Accordingly, for satisfying these requirements, the post-treatment after spinning such as heat treatment and acetalization treatment in production of vinylon as described above has been practiced.

The present inventors have made various investigations about production of a novel fiber having characteristics and functions not obtained in the fibers of the prior art as described above, and consequently found that a fiber having physical properties and functions not obtained in the fibers of the prior art can be provided by obtaining a fiber comprising a gel to accomplish the present invention.

SUMMARY OF THE INVENTION

Accordingly, an object of the present invention is to provide a process for producing a fiber comprising a gel having the physical properties and functions not obtained in the fibers of the prior art, having, for example, the property of reversibly swelling and shrinking according to the change in the environment under which it is placed.

According to an aspect of the present invention, there is provided a process for producing a gel fiber, comprising the step (X) of spinning a solution of at least one constituent component for a gel to solidify said solution into a fiber and the step (Y) of changing said component into a gel.

According to another aspect of the present invention, there is provided a process for producing a gel fiber, comprising the step (X') of spinning a solution containing a polymer as the constituent component for a gel according to the wet spinning method to solidify said solution into a fiber, and the step (Y') of changing the above polymer into a gel.

According to a further aspect of the present invention, there is provided a process for producing a gel fiber, comprising the step (X'') of spinning a solution containing a polymer as the constituent component for a gel according to the dry spinning method to solidify said solution into a fiber, and the step (Y'') of changing the above polymer into a gel.

According to a still further aspect of the present invention, there is provided a process for producing a gel fiber, comprising the step (N) of spinning a solution containing at least one polymer comprising as its constituent component at least one N-substituted acrylamide type monomer as the constituent component for a gel to solidify the solution into a fiber and the step (M) of forming a gel which can be swelled or shrinked reversibly by an external action via the crosslinking reaction of the spun fiber.

DETAILED DESCRIPTION OF THE PREFERRED EMBODIMENTS

Figure 1:
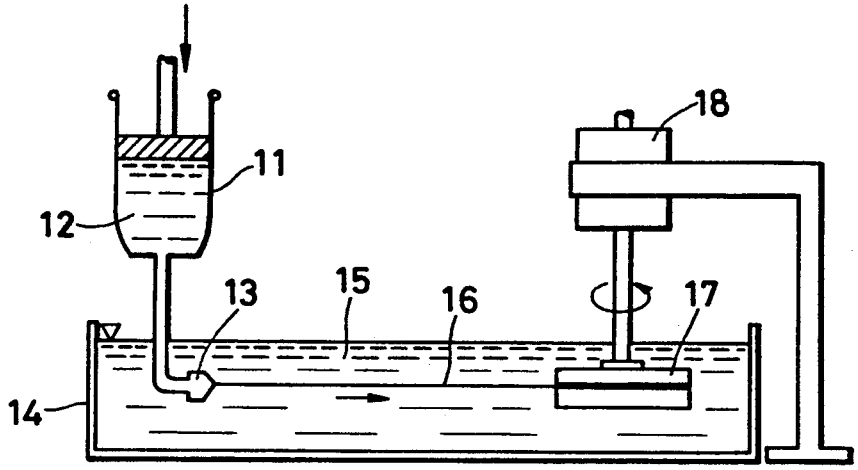
FIG. 1 and FIG. 2 are schematic illustrations of devices to be used for the process of the present invention, FIG. 1 showing a device in carrying out wet system spinning, FIG. 2 showing a device in carrying a dry system spinning.

The present invention is a process for producing a gel fiber, comprising the step of spinning a solution containing at least one component which can constitute a gel to solidify said solution into a fiber and the step of crosslinking the component to said solution into a gel.

That is, the process of the present invention has its specific feature in spinning a source material solution which can constitute a gel by crosslinking reaction, and crosslinking the fibrous source material obtained to form a network structure inherent in a gel, thus forming a fiber comprising a gel. Accordingly, the crosslinking step in the process of the present invention is the step of changing greatly the structure itself on the molecular level of the fiber, which is greatly different in its intended purpose from the finishing step for improvement of the physical properties after the spinning step in the production steps of the fiber of the prior art as described above.

The principal steps in the process of the present invention are described in detail below.

The dope for spinning to be used in the present invention can be prepared by dissolving the components which can constitute a gel having desired properties via crosslinking reaction in an appropriate solvent.

The crosslinking reaction in the present invention is inclusive of the crosslinking reaction between crosslinkable polymers and the crosslinking reaction between the polymers in the presence of a crosslinking agent. Accordingly, the type of the dope for spinning prepared here may be broadly classified, for example, as follows depending on the method for crosslinking the polymer:

(a) The type containing at least one crosslinkable polymer;

(b) The type containing at least one polymer which has itself no crosslinkability, but can be crosslinked in the presence of a crosslinking agent or irradiation by a radiation such as $\gamma$-ray;

(c) The type containing at least one polymer having itself no crosslinkability and a crosslinking agent for crosslinking these polymers;

(d) The hybrid type comprising two or more of the above a to c.

The above crosslinkable polymers may be homopolymers and copolymers of crosslinkable monomers as well as copolymers of monomers having no crosslinkability and monomers having crosslinkability.

The polymer to be used in the dope for spinning may be any polymer having a portion capable of constituting the skeleton of a gel in the whole or a part of its structure, and a polymer having the monomeric composition and polymerization degree corresponding to the desired physical properties and functions, etc., of the product may be suitably selected and used.

For example, as the starting material polymer in producing a fiber comprising a gel having the properties of reversibly swelling and shrinking (swelling and shrinking characteristic) according to an external action such as change in environment in which it is placed, etc., there may be employed straight chain polymers, including polymers of vinyl monomers such as N-substituted acrylamide, etc., or copolymers of these; polyimines such as polyethyleneimine, etc.; polyesters such as polyoxyethyleneadipoyl, etc.; polyamides such as polyglycine, etc. Among them, it is particularly preferable to use a N-substituted acrylamide type polymer, namely a polymer having at least one of monomers such as N-n-propylacrylamide, N-n-propylmethacrylamide, N-isopropylacrylamide, N-isopropylmethacrylamide, N-cyclopropylacrylamide, N-cyclopropylmethacrylamide, N,N-ethylmethylacrylamide, N,N-diethylacrylamide, N-acrylpyrrolidine, N-acrylpiperidine, etc., as the constituent component.

When employing such a polymer, if a polymer having hydrophobic substituent as the N-substituent is employed, for example, the phase transition temperature from the swelled state to the shrinked state of the gel obtained in water tends to be lowered. On the contrary, if a polymer having hydrophilic substituent is employed, the phase transition temperature tends to become higher. In view of these facts, the starting monomers constituting the polymer may be also selected.

Further, it is also possible to use a copolymer having crosslinkability prepared by copolymerization of a crosslinkable monomer into the polymer during the formation stage of these polymers as the starting polymer for formation of the fiber according to the process of the present invention. Examples of the crosslinkable monomer to be used in this case may include compounds having a plural number of sites in the molecule capable of causing polymerization reaction or compounds having a plural number of sites in the molecule capable of causing condensation or addition reaction, such as divinylbenzene, ethylene dimethacrylate, glycidyl methacrylate, N-methylolacrylamide, glutaraldehyde, dimethylolurea, epichlorohydrin, phenyl diisocyanate, etc.

As the crosslinking agent to be contained in the dope for spinning of the above type (c), it may be suitably selected depending on the starting material polymer to be used. For example, as the crosslinking agent in forming a polymer gel having the above swelling and shrinking characteristic as mentioned above, a bisazide compound such as the compound represented by the structural formula of

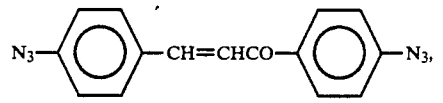

etc., or a bifunctional compound such as dimethylolurea, etc., may be employed.

The solvent for forming the dope for spinning may include water or alcohols such as methanol, ethanol, etc.; ketones such as acetone, methyl ethyl ketone, etc.; hydrocarbon type solvent such as pentane, cyclohexane, benzene, etc.; halogenated hydrocarbon type solvents such as tetrachloroethane, dichlorobenzene, etc.; esters such as isoamyl acetate, ethyl formate, etc.; ethers such as dioxane, diglyme, etc.; amides such as dimethylformamide, dimethylacetamide, etc.; sulfur-containing solvent such as dimethyl sulfoxide, etc., and other organic solvents, mixed solvents of these; and solutions having salts such as lithium perchlorate, ammonium propionate, etc., organic compounds such as urea, glucose, etc., added to these, which can be suitably selected depending on the starting material polymer employed.

The dope for spinning may also contain conveniently in appropriate amounts various additives such as various surfactants, small amounts of water-soluble salts, etc.

The composition of the dope for spinning, particularly the concentration of the starting material polymer is selected suitably within the range in which physical properties such as viscosity to enable practice of good spinning step can be obtained in the spinning for dope so that desired physical properties may be obtained in the product. It cannot be defined indiscriminately but differs depending on the solvent, additive and a starting polymer employed, but the starting polymer concentration in the case of spinning according to the wet spinning method as described below may be about 1 to 15 wt. %, preferably 2 to 10 wt. %, and, in the case of the dry spinning method, about 5 to 30 wt. %.

By use of a dope for spinning as described above, the spinning step in the process of the present invention is practiced. For the spinning step, for example, either the wet method or the dry method can be applied. Referring now to the drawing, the spinning step according to the wet method or the dry method is to be described.

FIG. 1 shows an example of the device to be used in practicing the spinning step in the process of the present invention according to the wet method.

In this system, the dope for spinning 12 is filled in a pressure extruder 11 and extruded by an appropriate extruding means at a predetermined flow rate through a nozzle 13 into a coagulation bath 14 to be spun. The starting polymer in the dope 12 extruded in the coagulation bath 14 is coagulated and taken up on a take-up instrument having a disc 17 rotating at a predetermined rotational number while forming a fiber 16 comprising a coagulated product. Thus, the fiber 16 comprising a coagulated product of the starting polymer is formed. In the fiber obtained here, the polymer is not gelled.

In the wet spinning method, it is also possible to incorporate a crosslinking agent or other additives, etc., in the coagulation liquid 15 into the fiber 16 at the stage of coagulating the polymer.

The coagulating liquid 15 employed here may be suitably selected depending on the kind of the starting polymer used in the dope for spinning 12. For example, a concentrated aqueous solution of an inorganic salt such as sodium chloride, sodium sulfate, ammonium sulfate, calcium chloride, etc., can be used.

The disc 17 of the take-up instrument is coupled with a motor 18 for driving the disc, and the rotational number of the motor 18 is controlled by a controller (not shown).

The operational conditions such as aperture diameter of nozzle, extrusion rate of the dope for spinning, take-up speed of fiber, etc., may be selected suitably depending on the cross section of the fiber finally obtained, or physical properties or functions such as strength, in view of the viscosity of the dope or the kind of the coagulating liquid.

Accordingly, the physical properties and the function of the final product can be also controlled by controlling the viscosity of the dope or the kind of the coagulating liquid at this wet spinning stage.

Figure 2:
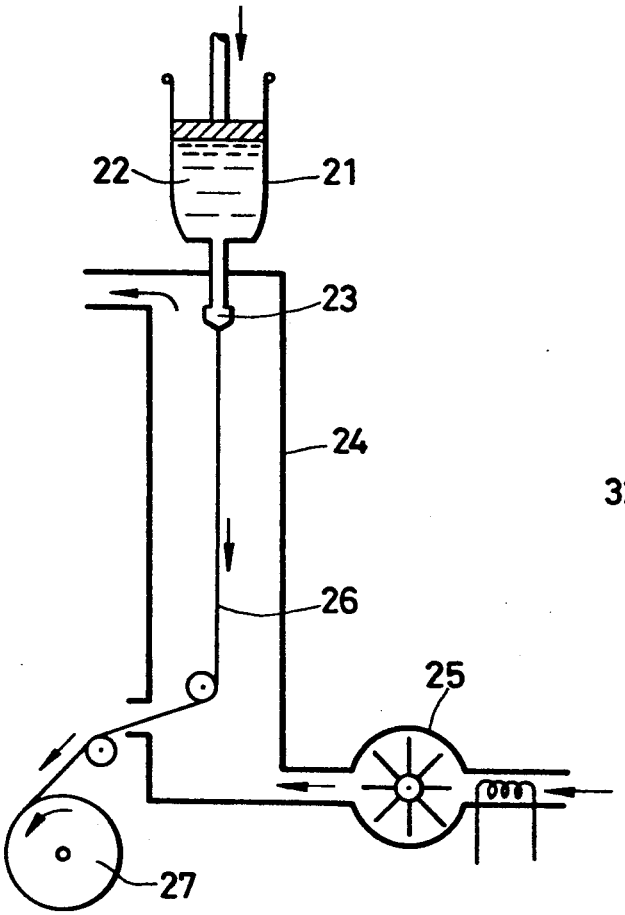

On the other hand, FIG. 2 shows an Example of the device to be used in the spinning step according to the dry spinning method.

In this device, the dope for spinning 22 filled in a pressure extruder 21 is extruded by an appropriate extruding means at a predetermined flow rate through a nozzle 23 into a spinning cylinder 24 and at the same time taken out as the fiber 26 from the upper portion of the spinning cylinder 24 through a guide roller onto a take-up roller 27 placed below. Into the spinning cylinder 24 is supplied hot air from a hot air feeder 25, and the extruded polymer solution is dried to become the fiber 26.

The operational conditions in the spinning step according to the dry spinning method such as aperture diameter of nozzle, extrusion rate of the dope for spinning, take-up speed of fiber, temperature of hot air, etc., may be also suitably selected depending on the cross section of the fiber finally obtained, or the physical properties or function such as strength, etc., and they can be also controlled by controlling the viscosity of the dope or these operational conditions at this stage of spinning.

The fiber comprising a coagulated product of the starting material, optionally containing a crosslinking agent, becomes a gel fiber by passing through the crosslinking step.

For the crosslinking step in the present invention, various crosslinking methods may be applicable depending on the type of the starting material solution to be used.

More specifically, corresponding to the types of the dope for spinning as previously described, the following methods may be employed.

(1) When a dope for spinning of the type (a) is used, a crosslinking method corresponding to the crosslinkability of the starting metal is used. In this case, when the starting material is, for example, a polymer crosslinkable by heat, the fiber obtained in the spinning step is treated by heating, or alternatively when it is a polymer crosslinkable by irradiation of light such as UV-ray, photo-irradiation treatment is effected on the fiber obtained in the spinning step.

(2) When a spinning dope of the type (b) is used, there may be employed the method in which radiation such as $\gamma$-ray is irradiated on the fiber obtained in the spinning step, or the method for spinning in which a crosslinking agent is supplied into the fiber and heat treatment or a light irradiation treatment is applied depending on the crosslinking agent employed. As the method for supplying the crosslinking agent into the fiber when this crosslinking method is applied, there may be employed, for example, a method in which a crosslinking agent is added into the coagulating liquid in the wet spinning method and the crosslinking agent is incorporated into the fiber simultaneously with fiber formation of the polymer, namely at the stage of coagulation of the polymer, a method in which a solution of a crosslinking agent is separately prepared and the fiber comprising the coagulated product of the polymer formed is impregnated therewith, etc. As the crosslinking agent of this kind, there may be employed, for example, bifunctional compounds such as formaldehyde, glutaraldehyde, epichlorohydrin, phenyldiisocyanate, sodium 4,4'-diisothiocyanostilbene-2,2'-disulfonate, etc.

(3) When a dope for spinning of the type (c) is used, a method for crosslinking such as heat treatment, light irradiation treatment corresponding to the kind of the crosslinking agent contained in the dope for spinning may be employed.

(4) When the dope for spinning of the type (d) is used, the above crosslinking methods of (1)–(3) may be suitably combined.

The crosslinking step in the process of the present invention can be practiced according to a method in which a region for crosslinking to perform heating or light irradiation is provided at an appropriate site in the spinning bath of the wet system or within the spinning cylinder of the dry system as shown in FIG. 1 or FIG. 2, and the crosslinking reaction is carried out by permitting the coagulated product of the fibrous starting material solution extruded through the nozzle (containing optionally a crosslinking agent) to pass through the crosslinking region, or alternatively the crosslinking reaction is carried out under the state taken up on the take-up instrument or after feeding optionally a crosslinking agent thereto, at that place or after migration to another suitable place.

The crosslinking density of the gel (polymer) may be selected depending on the desired physical properties or functions such as swelling ratio, etc. of the final product, and can be controlled by the operational conditions such as the kind or concentration of the polymer or the crosslinking agent employed, temperature during the crosslinking step, the reaction time the light irradiation intensity, etc. In the case of a gel having swelling and shrinking characteristic, as the crosslinking density becomes higher, for example, the swelling ratio in water tends to become higher.

By such a crosslinking reaction, crosslinking occurs between the polymer molecules to form a network structure inherent in gel, whereby the fiber which was a coagulated product of the starting material solution changes to a fiber comprising a gel. The product obtained may be further subjected optionally to an additive step such as stretching treatment, etc., to become a final product.

The gel fiber formed according to the process of the present invention as described above has various characteristics and functions inherent in gel not obtained in the fibers of the prior art.

For example, the gel formed by use of the starting materials for formation of a gel (polymer) having the swelling and shrinking characteristic as previously mentioned has great swelling and shrinking characteristic by external action such as change in temperature, salt concentration, pH, etc., of the environment in which it is placed.

For example, when this gel is arranged in water and the temperature is lowered, the gel becomes a swelled state, while a shrinked state when the temperature is elevated. Besides, the shrinkage obtained thereby is very great. Also, this step of swelling and shrinking (phase transition) will change critically at a constant phase transition point and is also reversible.

Such a swelling and shrinking characteristic (phase transition characteristic) of the gel can be also obtained by the change in salt concentration, pH, etc., in the surrounding solvent. Besides, it is possible to set various phase transition points defined by desired environmental factors by varying the environmental factors such as temperature, salt concentration, pH, etc. For example, by setting suitably the environmental factors other than temperature such as salt concentration, pH, etc., a desired phase transition temperature can be obtained. Alternatively, by setting suitably the environmental factors other than pH such as salt concentration, temperature, etc., a desired phase transition point defined by the pH value can be obtained.

Such a swelling and shrinking characteristic may be considered to be primarily due to the change of the amide groups, etc., in the side chain of the polymer constituting the network structure of the gel from hydrophilic to hydrophobic corresponding to the change in temperature, salt concentration, pH, etc.

Also, the phase transition point during such swelling and shrinking is also controllable by, for example, the kind of substituent at the N-position of acrylamide or the crosslinking density of the gel, etc., as previously stated.

The fiber comprising the gel having swelling and shrinking characteristic thus obtained, either singly or as a bundle, or as fabricated in a cloth, can be used for converting the change in temperature, salt concentration, pH, etc., to a mechanical change accompanied with swelling and shrinking, and therefore utilizable as, for example, an actuator, a filter material and the like to be changed in transmission state of a solution depending on the temperature, pH, the salt concentration of the solution.

The present invention is described in more detail by referring to the following Examples.

EXAMPLE 1

2.5 g of N-isopropylacrylamide, 0.5 g of N-methylolacrylamide and 15 mg of ammonium persulfate were dissolved in 100 ml of cold water, and further 40 μl of tetramethylethylenediamine was added thereto, and polymerization was carried out at room temperature with bubbled nitrogen gas for 2 hours. After completion of polymerization, the polymer solution obtained was poured into hot water, and the precipitate was filtered off and dried to obtain a copolymer.

Next, the polymer obtained was dissolved in water to a concentration of 5% to prepare a dope for spinning.

Further, the dope for spinning was filled in a pressure extruder of a wet system spinning device as shown in FIG. 1 and extruded at a rate of 0.09 ml/min. through a nozzle with an aperture size of 1 mm into a saturated solution of sodium sulfate as the coagulating liquid, and the fibrous product was taken up on a take-up roller made of Teflon with a diameter of 18 cm. The take-up speed was controlled to 0.5 cm/sec.

After the fiber was taken up on the take-up roller in 20 winds, the fiber together with the roller was placed in a vacuum oven to be subjected to heat treatment under degasification at 150° C. for 10 hours to crosslink the polymer constituting the fiber, thereby changing it to a gel.

When the fiber obtained was dipped in water of 25° C., swelling of the fiber was recognized. When the fiber under this state was transferred into water of 50° C., the fiber was shrinked with its shrinkage being 40% of the swelled state. Further, when this was withdrawn into the air (20° C.), it again swelled and its length recovered to the previous state in water of 25° C. When the fiber under this swelled state was dipped into a saturated solution of sodium chloride (25° C.), it shrinked by 40%.

EXAMPLE 2

In the same manner as in Example 1 except for using glycidyl methacrylate in place of N-methylolacrylamide, a polymer powder was obtained.

Next, the polymer powder obtained was dissolved in water to a concentration of 6% to prepare a dope for spinning, and spinning was practiced by the same manner as in Example 1.

The spinning operation was stopped when the fiber was taken up in 20 winds on the take-up roller, and at that place UV-ray from a xenon light source of 500 w positioned at a distance of 30 cm apart from the fiber was irradiated on the fiber on the take-up roller for 5 hours to effect crosslinking, whereby a fiber comprising a gel was obtained.

The swelling and shrinking characteristic of the fiber obtained was examined similarly as described in Example 1. As the result, a shrinkage of 45% was obtained.

EXAMPLE 3

In the same manner as in Example 1 except for using acrylamide in place of N-methylolacrylamide, a polymer powder was obtained.

Next, 100 ml of a 5% aqueous solution of the powder obtained was prepared and 0.5 g of dimethylolurea was dissolved therein to provide a dope for spinning.

By use of the dope for spinning, spinning was practiced in the same manner as in Example 1.

The spinning operation was stopped when the fiber was wound 20 times on the take-up roller, and the fiber on the take-up roller was placed in a vacuum oven together with the roller to be subjected to heat treatment at 130° C. for 10 hours to crosslink the polymer constituting the fiber, thereby changing it to a gel.

The swelling and shrinking characteristic of the fiber obtained was examined similarly as in Example 1. As the result, shrinkage of 40% was obtained.

EXAMPLE 4

The polymer powder obtained in Example 3 was dissolved in water to a concentration of 5% to prepare a dope for spinning.

By use of this dope for spinning, spinning was practiced in the same manner as in Example 1.

The spinning operation was stopped when the fiber was wound 20 times on the take-up roller, and the fiber on the take-up roller together with the roller was dipped in an aqueous solution containing 5% of formaldehyde, 15% of sodium sulfate and 20% of sulfuric acid, and the crosslinking reaction was carried out by maintaining the liquid temperature at 50° C. for 1 hour to obtain a fiber comprising a gel. The swelling and shrinking characteristic of the fiber obtained was examined in the same manner as in Example 1. As the result, a shrinkage of 40% was obtained.

EXAMPLE 5

3 g of N-isopropylacrylamide and 15 mg of ammonium persulfate were dissolved in 100 ml of cold water, and further 40 μl of tetramethylethylenediamine was added thereto, and polymerization was carried out at room temperature with bubbled nitrogen gas for 2 hours. After completion of polymerization, the polymer solution obtained was poured into hot water, and the precipitate was filtered off and dried to obtain a polymer powder.

Next, a 5% aqueous solution of the powder obtained was prepared to provide a dope for spinning, and spinning was practiced in the same manner as in Example 1.

The spinning operation was stopped when the fiber was wound 20 times on the take-up roller, and at that place on the fiber on the take-up roller was irradiated γ-ray from $Co^{60}$ at a dose of 0.17 MR/hr for 7 hours to effect crosslinking, whereby a fiber comprising a gel was obtained.

The swelling and shrinking characteristics of the fiber obtained were examined similarly as described in Example 1. As the result, a shrinkage of 40% was obtained.

EXAMPLE 6

By use of the dope for spinning obtained in Example 1, spinning was carried out by a dry spinning device as shown in FIG. 2.

The nozzle diameter was 1 mm, the extrusion rate of the dope for spinning 1 mm/min., the take-up speed 5 cm/sec., and the temperature of the hot air 90° C.

The spinning operation was stopped when the fiber was wound 20 times on the take-up roller, and the fiber on the take-up roller together with the roller was placed in a vacuum dryer to be subjected to heat treatment at 120° C. for 10 hours to crosslink the polymer constituting the fiber, thereby changing it to a gel.

The swelling and shrinking characteristics of the fiber obtained were examined similarly as described in Example 1. As the result, a shrinkage of 40% was obtained.

APPLICATION REFERENCE EXAMPLE

Figure 3:
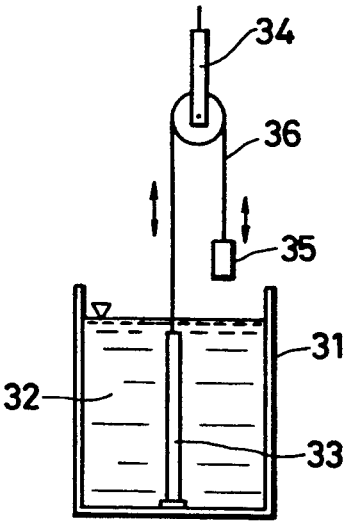
FIG. 3 is a schematic illustration showing an application example of the fiber produced according to the present invention.

Twenty of the fibers obtained in Example 1 were bundled to form a bundle of fibers 33 comprising a gel, which was arranged in water 32 of 25° C. within a vessel 31 as shown in FIG. 3. The lower end of the gel fiber bundle 33 was fixed at the bottom of the vessel 31, while to the upper end was connected a weight 35 of 2 g by a strand 36 hung over a pulley 34. Under the state having thus the weight 35 suspended, the water temperature within the vessel 31 was raised to 50° C. whereby the weight 35 was lifted up by the shrinking action of the gel fiber bundle 33. Further, when the water temperature within the vessel 31 was again returned to 25° C., the weight 35 was returned to the original position. By repeating such operations continuously, the weight 35 could be lifted up and let down.

By the process of the present invention, it has become possible to provide a gel fiber having characteristics and functions inherent in a gel not obtained in the fibers of the prior art, for example, the properties of reversibly swelling and shrinking according to the changes in environment in which it is placed.

What is claimed is:

1. A process for producing a gel fiber, comprising a step (N) of spinning a solution containing as a constituent component for a gel at least one polymer having at least one monomer unit selected from the group consisting of N-n-propylacrylamide, N-n-propylmethacrylamide, N-iso-propylacrylamide, N-isopropylmethacrylamide, N-cyclopropylacrylamide, N-cyclopropylmethacrylamide, N,N-ethylmethylacrylamide, N,N-diethylacrylamide, N-acrylpyrrolidine, N-acrylpiperidine, to solidify the solution into a fiber, and the step (M) of effecting crosslinking of the fiber to form a gel which can be swelled or shrunk reversibly by a thermal action in the presence of a liquid.

2. A process according to claim 1, wherein said solution contains at least one solvent selected from the group consisting of water, alcohols, ketones, hydrocarbons, halogenated hydrocarbons, esters, ethers, amides, and sulfur-containing solvents.

3. A process according to claim 1, wherein the wet spinning method is applied in said step (N).

4. A process according to claim 1, wherein the dry spinning method is applied in said step (N).

5. A process according to claim 4, wherein the solution contains 5 to 30% by weight of a polymer.

6. A process according to claim 3, wherein the solution contains 1 to 15% by weight of a polymer.

7. A process according to claim 1, wherein said solution contains a crosslinkable polymer.

8. A process according to claim 1, wherein said solution contains a polymer and a crosslinking agent.

* * * * *

UNITED STATES PATENT AND TRADEMARK OFFICE

CERTIFICATE OF CORRECTION

PATENT NO. : 5,011,644

DATED : April 30, 1991

INVENTOR(S) : MASAHIRO HARUTA, ET AL.

It is certified that error appears in the above-identified patent and that said Letters Patent is hereby corrected as shown below:

COLUMN 2

Line 4, "formaldhyde" should read --formaldehyde,--.

COLUMN 3

Line 6, "carrying a" should read --carrying out a--.
Line 18, "to" should read --in--.

COLUMN 7

Line 27, "time the" should read --time, the--.

Signed and Sealed this

Fifteenth Day of December, 1992

*Attest:*

DOUGLAS B. COMER

*Attesting Officer*

*Acting Commissioner of Patents and Trademarks*